United States Patent [19]

Chenot

[11] 4,128,054

[45] Dec. 5, 1978

[54] TRASH COMPACTOR

[75] Inventor: Louis A. Chenot, Grundy Center, Iowa

[73] Assignee: Mid-Equipment, Inc., Grundy Center, Iowa

[21] Appl. No.: 847,664

[22] Filed: Nov. 1, 1977

Related U.S. Application Data

[63] Continuation-in-part of Ser. No. 789,348, Apr. 21, 1977.

[51] Int. Cl.[2] ..... B30B 15/06

[52] U.S. Cl. ..... 100/233; 100/295

[58] Field of Search ..... 100/233, 295; 214/83.3

[56] References Cited

U.S. PATENT DOCUMENTS

| | | | |
|---|---|---|---|
| 2,171,235 | 8/1939 | Gates | 100/233 X |
| 3,709,389 | 1/1973 | Steltz | 100/233 X |
| 3,881,407 | 5/1975 | Goar | 100/233 X |

*Primary Examiner*—Billy J. Wilhite

*Attorney, Agent, or Firm*—Zarley, McKee, Thomte, Voorhees & Sease

[57] ABSTRACT

The trash compactor of the present invention utilizes a three piece toggle linkage mechanism for moving the compactor blade from its inoperative to its operative position. The toggle linkage includes a frame link hinged to the frame of the compactor, a primary link hinged to the frame link, and a blade link pivotally connected to the primary link and also pivotally connected to the compactor blade. Hydraulic cylinders are operatively connected to the linkage mechanism for causing movement of the compactor blade from its initial position to its compacting position. Another feature of the trash compactor, includes a counterbalance mechanism for the door to the compactor, the counterbalance mechanism being adapted to neutralize the weight of the door throughout the swinging movement of the door from its open to its closed position. A safety interlock is engaged by a cam plate on the door so that the hydraulic system is inoperative whenever the door is open. Structure is included for avoiding back packing.

2 Claims, 16 Drawing Figures

TRASH COMPACTOR

BACKGROUND OF THE INVENTION

This application is a continuation-in-part application of Ser. No. 789,348 filed Apr. 21, 1977.

One presently known method for disposal of trash involves the use of large trash compactors which may be periodically loaded onto flat bed truck trailers and hauled to land fills for emptying. These trash compactors include an elongated container having at one end a hopper for inserting the trash. A compactor blade is pivotally mounted at the hopper end of the container and is actuated by hydraulic means for compacting the trash toward the opposite end of the container. Compactor blade is pivoted about a horizontal axis at the bottom of the container and pivots about this axis to force the trash toward the opposite end of the container.

Various means have been utilized for applying the compacting force to the pivoting compactor blade. However, the means for applying the force to the compactor blade must fit within a rather confined area. Therefore, a problem which is commonly encountered is the ability to apply a substantial force to the compactor blade during the initial pivoting movement of the blade. Furthermore, as the blade pivots from its initial position throughout an arc of approximately 90°, the mechanism for applying force to the blade must adapt to these varying positions so as to apply sufficient force to the blade.

Toggle linkages can be used for applying the force from a hydraulic extensible cylinder to the pivoting blade, but certain problems are encountered with the use of toggle linkages. When a toggle linkage is in a folded position, it is capable of applying only a small force to the blade, and when the toggle linkage is in an expanded position, it applies a significantly greater force to the blade. Consequently, the force during the initial stroke of the blade is often inadequate with the use of toggle linkages, and the force applied to the blade at the end of the compaction stroke can be so great as to do physical damage to the blade.

Another problem encountered with presently known compactors is the difficulty in providing a counterbalance for the hopper door. These doors are often very heavy, weighing as much as 500 pounds, and a counterbalance is necessary in order to permit the person using the container to lift the hopper door with ease. Usually a spring is utilized for a counterbalance, but the force applied by a spring varies as the spring expands and contracts. Similarly, as the door pivots upwardly, the vertical downward moment of the door about the door's pivotal axis changes. The result of these factors is that presently known doors often fly upwardly after they are initially opened, thereby creating the danger that the person opening the door may be hit by the rapid upward movement of the door.

Another problem encountered with presently known devices is the danger that the compactor blade may become actuated during the time that trash is being inserted into the hopper. Accidental actuation of the compactor blade during the time that trash is being inserted could result in physical injury to the person inserting the trash. A further problem is that refuse tends to back pack behind the compactor blade.

SUMMARY OF THE INVENTION

The present invention utilizes a three link toggle system for moving the compactor blade from its initial position to its compacting position. The toggle system is capable of increasing the power during the initial stroke of the hydraulic cylinder, and it is further capable of decreasing the power applied to the compactor blade at the latter part of the stroke. Consequently, a greater power is applied during the initial pivotal movement of the compactor blade, and the power is prevented from becoming too great near the end of the compactor blade's movement, thereby preventing damage to the structure of the blade or the other components of the container. The present toggle system makes possible the reduction of the number of hydraulic cylinders from four as presently used in conventional devices, to two. Furthermore, the size of the hydraulic motor needed to drive the hydraulic cylinders may be smaller than in previous devices. Also, the weight of the parts and the number of parts for actuating the compactor blade are reduced from presently known devices.

The present invention also involves the use of a counterbalance for the upward swinging door of the hopper. A cam is mounted on the door and is engaged by a cam follower which is driven by compression spring. The cam follower applies a force to the cam to counterbalance the weight of the door during upward swinging movement. The cam has an arcuate surface which is chosen so as to change the force applied by the cam follower in such a manner that the weight of the door is neutralized throughout the swinging movement from its closed to its open position.

Another feature of the present invention involves the use of an interlock valve which is engaged by a cam on the door to the hopper. As the door to the hopper is opened, the interlock valve is moved to a closed position so as to prevent actuation of the hydraulic system during the time that the door is open. Thus, the interlock prevents accidental actuation of the compactor blade during the time that trash is being inserted into the hopper.

Therefore, a primary object of the present invention is the provision of an improved trash compactor.

A further object of the present invention is the provision of a trash compactor having a toggle system which applies greater power during the initial stroke of the hydraulic cylinders and less power during the end of the stroke.

A further object of the present invention is the provision of a toggle system which applies the same or greater compacting force with fewer hydraulic cylinders and a smaller hydraulic motor than used in presently known devices.

A further object of the present invention is the provision of a device which has improved safety features over the devices presently known.

A further object of the invention is the provision of a trash compactor which includes an improved counterbalance mechanism for the hopper door.

A further object of the present invention is the provision of a device which has a counterbalance mechanism for the door which is safer than those presently known.

A further object of the present invention is the provision of a trash compactor having a counterbalance mechanism for the door which neutralizes the weight of the door throughout its swinging movement.

A further object of the present invention is the provision of a trash compactor which includes an interlock safety mechanism connected to the hydraulic system to prevent operation of the hydraulic system during the time that the door is open.

A further object of the present invention is the provision of a trash compactor which is economical to manufacture, durable in use, and efficient in operation.

DETAILED DESCRIPTION OF THE DRAWINGS

Figure 1:
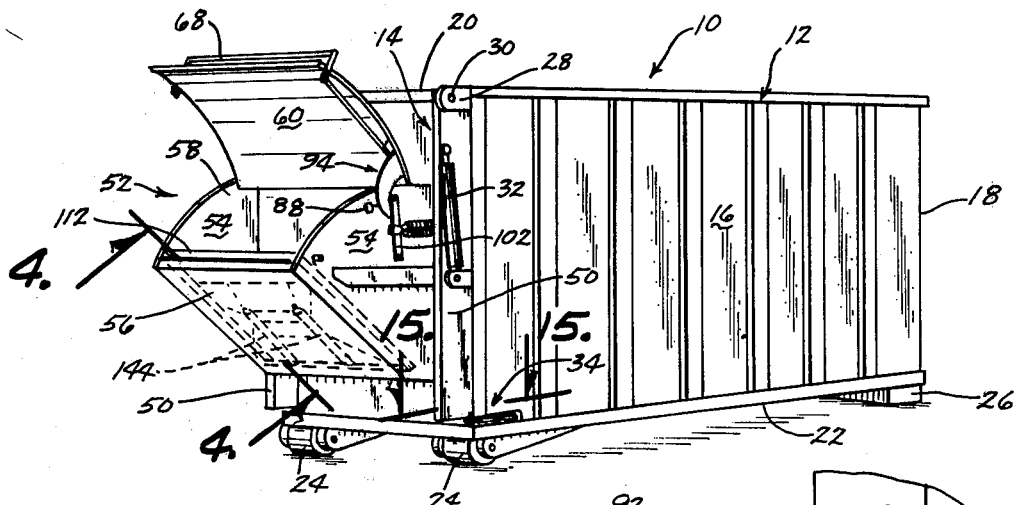
FIG. 1 is a perspective view of the trash compactor of the present invention.

Referring to FIG. 1, a trash compactor 10 is comprised of an elongated container 12 and a head assembly 14. Container 12 includes sidewalls 16 an enclosed end wall 18, and top and bottom walls 20, 22. Container 12 is supported by means of a pair of skids 24 and a support foot 26.

Head assembly 14 is pivotally mounted to a pair of ears 28 which extend forwardly from an open end of container 12, head assembly 14 pivoting about horizontal axis 30.

A hydraulic cylinder 32 is pivotally mounted at its opposite ends to head assembly 14 and to container 12 so that actuation of cylinder 32 causes head assembly 14 to pivot about axis 30 from a closed position as shown in FIG. 1 to an open position which permits the contents of container 12 to be emptied from its open forward end.

When head assembly 14 is in its closed position as shown in FIG. 1, it is secured to container 12 by means of a latch assembly 34. Latch assembly 34 is shown in detail in FIG. 15 and includes a lever 36 which is pivotally mounted to sidewall 16 of container 12 for pivotal movement about axis 38. Lever 36 includes a distal end 40 which is pivotally mounted to one end of a clamp link 42 for pivotal movement about an axis 44. Clamp link 42 includes a hook end 46 adapted to retentively engage a pin which is mounted on head assembly 14. As can be seen by the relative positions of pin 48, axis 38 and axis 44, lever 36 and link 42 operate in the manner of an over-center toggle clamp.

Figure 15:
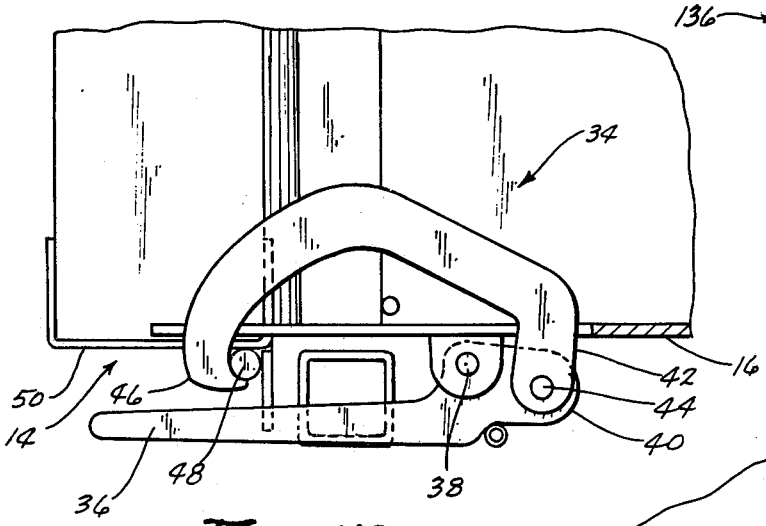
FIG. 15 is a sectional view taken along line 15—15 of FIG. 1.

Head assembly 14 includes a rectangular frame 50 which abuts against the open end of container 12 as shown in FIGS. 1 and 15. Extending outwardly from the forward edge of frame 50 is an inclined hopper 52 having lateral sidewalls 54, an inclined front wall 56, and an open upper end 58. Hopper 52 is in communication with the interior of container 12 thereby permitting trash to be inserted into container 12 through open end 58 of hopper 52.

A door 60 is pivotally mounted to rectangular frame 50 of head assembly 14 by means of a hinge 62 for pivotal movement about a horizontal axis 64. Door 60 is arcuate in configuration so as to conform to the margins of open end 58 of hopper 52. Door 60 is pivotal from a closed position shown in FIG. 2 to an open position shown in FIG. 3.

Pivotally mounted to the forward edge of door 60 for pivotal movement about an axis 66 is a handle 68. Handle 68 has on its inner end a catch member 70 which is adapted to retentively engage an inwardly extending pin 72 mounted to the inner surface of hopper sidewall 54.

Figure 2:
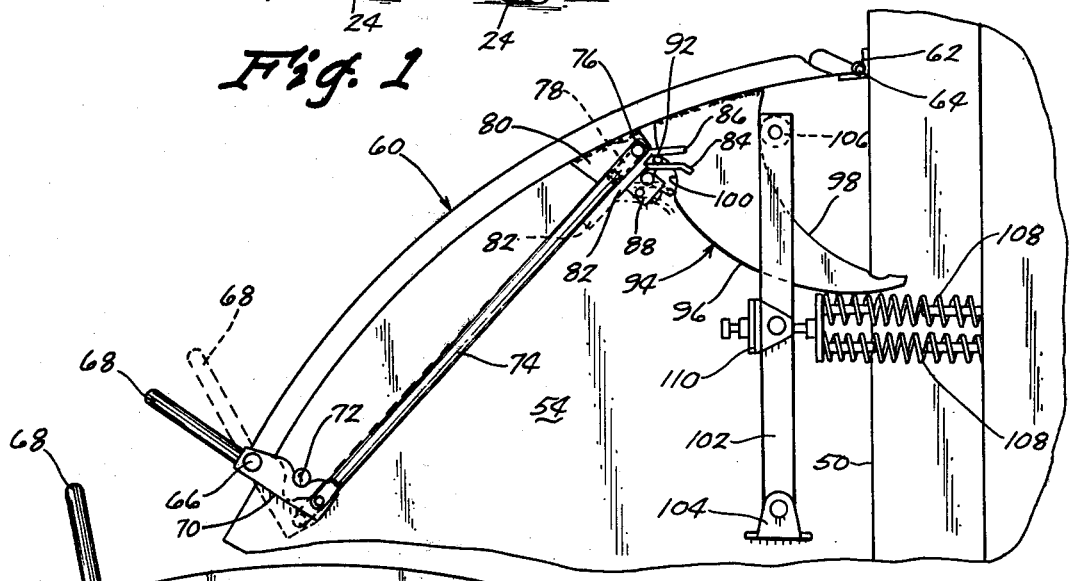
FIG. 2 is a partial side view of the hopper door of the trash compactor.

As shown in FIG. 2, handle 68 is pivotal in a clockwise direction away from pin 72 so as to release door 60 and permit it to swing upwardly.

Pivotally mounted to the inner end of handle 68 is an elongated rod 74 which extends upwardly therefrom. The upper end of rod 74 includes a pin 76 which is slidably mounted for reciprocating sliding movement in an elongated slot 78 in a bracket 80 which is rigidly mounted to the under surface of door 60. Thus, pivotal movement of handle 68 causes reciprocating movement of rod 74.

Also mounted on the upper end of rod 74 is an F-shaped member 82 having two spaced-apart fingers 84, 86. Mounted on the inner surface of side wall 54, is an override control valve 88 which is incorporated into the hydraulic circuit of the trash compactor. Valve 88 includes a pivotal arm 90 having a bearing pin 92 riding between the spaced-apart fingers 84, 86 of F-shaped member 82.

As handle 68 is pivoted in a clockwise direction to the position shown in shadow lines of FIG. 2, rod 74 is retracted to the left, thereby causing fingers 84, 86 to pivot control valve 88 from an initial position shown in solid lines in FIG. 2 to an override position shown in shadow lines in FIG. 2. In its override position, control valve 88 prevents actuation of the hydraulic system of the trash compactor.

Figure 3:
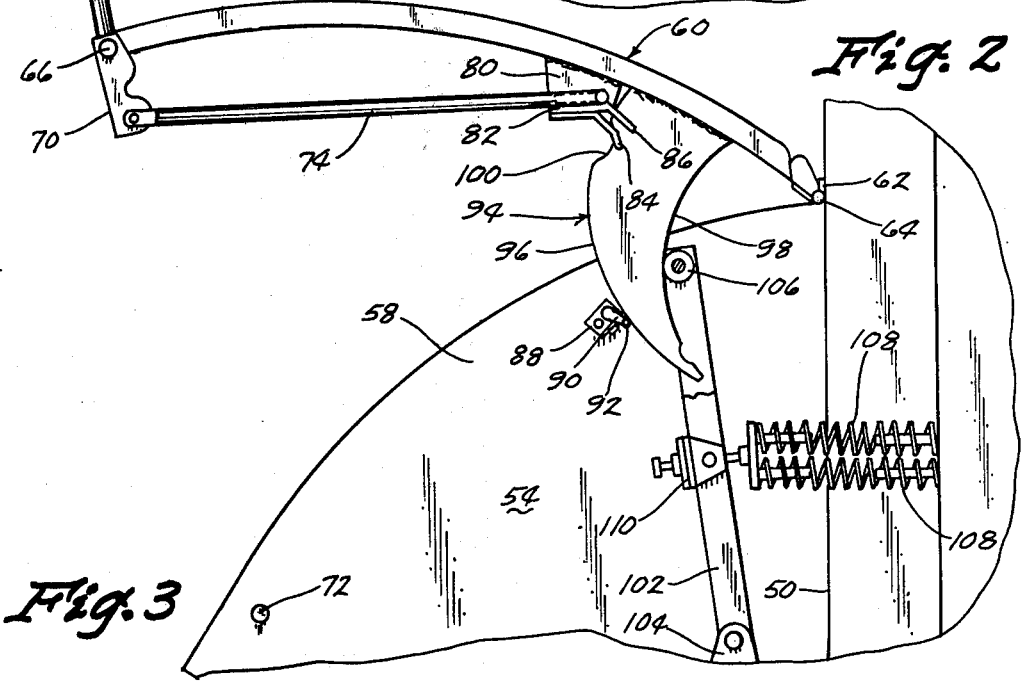
FIG. 3 is a view similar to FIG. 2 showing the door in its open position.

Rigidly mounted to the undersurface of door 60 is a cam plate 94. Cam plate 94 includes a valve cam surface 96 and a counterbalance cam surface 98. Valve cam surface 96 has an arcuate cut out portion 100 which permits valve 88 to pivot from its initial to its override position. As door 60 swings upwardly, cam surface 96 engages the pin 92 of valve 88 as shown in FIG. 3, and causes the valve to be retained in its override position. Thus, cam surface 96 prevents valve 88 from returning to its initial position, thereby preventing the possibility that the hydraulic system can be actuated during the time that the door is open. When the door is closed, fingers 84, 86 slide into embracing engagement with pin 92, and depression of handle 68 to the latched position causes fingers 84, 86 to rotate pin 92 and valve 88 to their initial position.

A counterbalance arm 102 is pivotally connected at its lower end to the outer surface of lateral side walls 54 by means of a hinge bracket 104. The upper end of arm 102 includes a cam roller 106 which engages counterbalance cam surface 98 for rolling movement thereagainst. A compression spring 108 is mounted on rectangular frame 50 of head assembly 14 and is also operatively connected to arm 102 intermediate its opposite ends by means of a bracket 110. Spring 108 is in compression, and therefore urges cam roller 106 against cam surface 98 of cam plate 94.

Referring to FIG. 2, the pressure exerted against cam surface 98 by cam roller 106, creates a moment on door 60 about its hinged pivotal axis 64. The moment created by cam roller 106 is opposite to the moment that is created by virtue of the weight of door 60. The arcuate surface of cam surface 98 is chosen in a predetermined pattern, so that regardless of the position of door 60, the moment in a clockwise direction about axis 64 approximately equals the counterclockwise moment created by the weight of the door. Thus, it is possible to raise the door 60 with only a slight manual pressure in an upward direction. Furthermore, as the door extends upwardly, the moment about axis 64 which is caused by the weight of the door changes drastically. The arcuate surface 98 is chosen so that the moment created by cam roller 106 changes so as to neutralize the weight of the door in any given position.

Referring to FIGS. 4–12, a compactor plate 112 is mounted within hopper 52 for swinging movement therein. Blade 112 is pivotally mounted about a horizontal axis 114 adjacent its lower end and pivots from an initial inoperative position shown in FIG. 4 through the positions shown in FIGS. 6 and 8 to a compacting position shown in FIG. 10 which is approximately 12° past vertical.

A toggle mechanism interconnects blade 112 with the inclined front wall 56 of hopper 52. The toggle linkage mechanism comprises three links: a frame link 116, a primary link 118, and a blade link 120. Frame link 116 is pivotally connected at one of its ends to inclined hopper wall 56 for pivotal movement about a first axis 122. The opposite end of frame link 116 is pivotally connected to the primary link for pivotal movement about a second axis 124. Primary link 118 is pivotally connected to blade link 120 about a third axis 126, and blade link 120 is pivotally connected to blade 112 for pivotal movement about a fourth axis 128. Axes 122, 124, 126 and 128 are provided by shafts identified in FIG. 12 by the numerals corresponding to axes 122, 124, 126 and 128.

Primary link 118 has an S-shaped configuration and includes three stop surfaces 130, 132 and 134. The specific purposes of stop surfaces 130, 132 and 134 will be discussed hereinafter.

Figure 12:
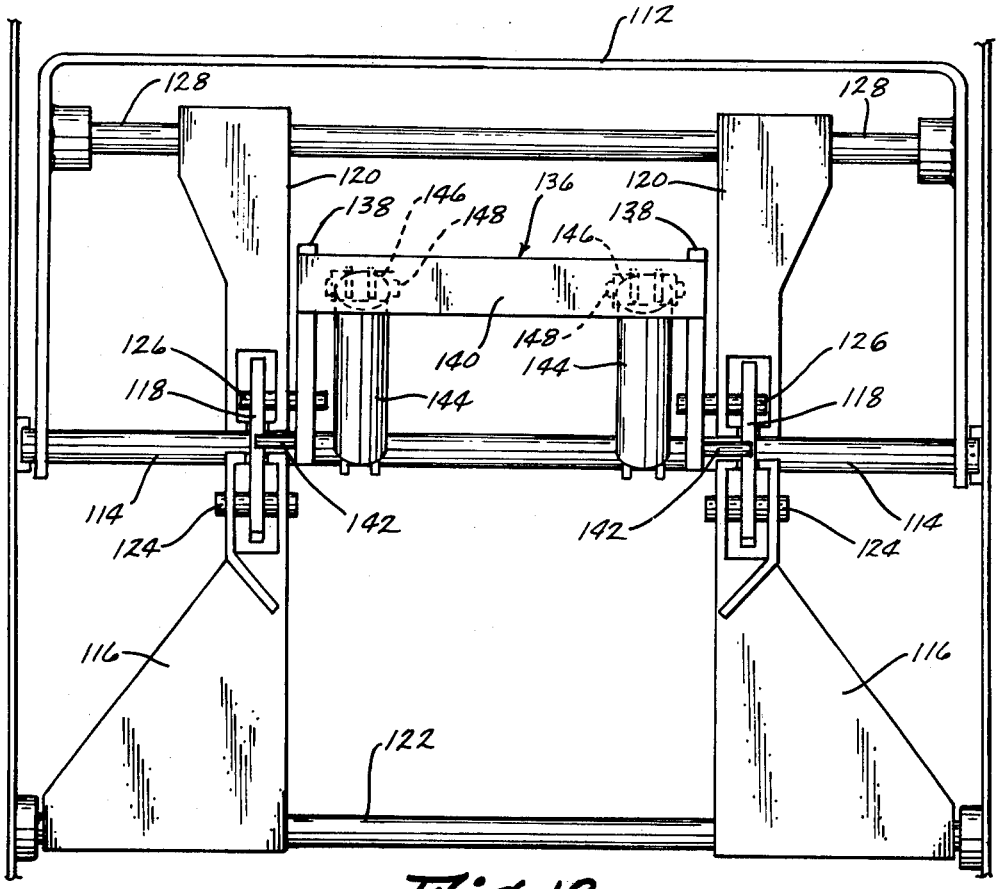
FIG. 12 is a sectional view taken along line 12—12 of FIG. 10.

Pivotally mounted to primary link 118 is a cylinder link 136. As can be seen in FIG. 12, cylinder link 136 includes a pair of side plates 138 which are interconnected by a cross member 140. As also can be seen from FIG. 12, links 116, 118 and 120 are provided in spaced-apart pairs with cylinder link 136 being positioned therebetween. Side plates 138 of cylinder link 136 are rotatably journaled for pivotal movement about an axis which coincides with axis 126. Extending outwardly from side plates 138 is a stub shaft 142 which is adapted to engage primary link 118 at times (See FIG. 4).

A pair of hydraulic cylinders 144 (FIGS. 1 and 12) are each connected at their lower ends to shaft 114 which provides the pivotal axis for compactor blade 112. The upper ends of cylinders 144 are pivotally connected to cylinder links 136 by means of bearings 146 (FIGS. 13 and 14) for rotation about a fifth axis 148.

Figure 4:
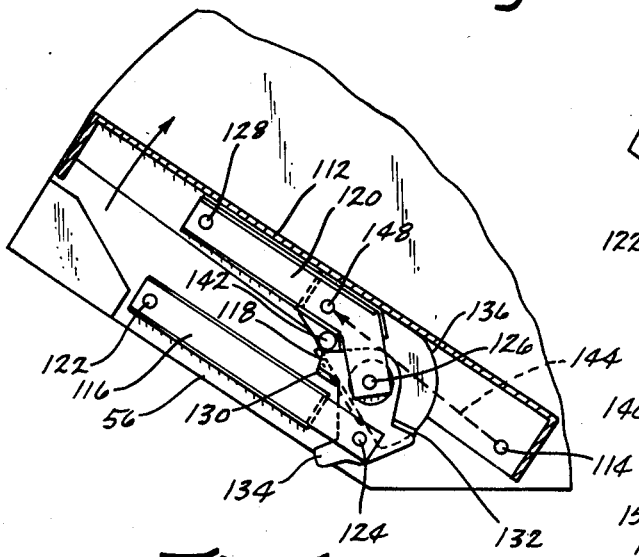
FIGS. 4, 6, 8 and 10 are partial sectional views showing the toggle linkage when the compactor blade is in its initial position, at 37°, at 90°, and at 12° or 13° past 90°, respectively.
Figure 5:
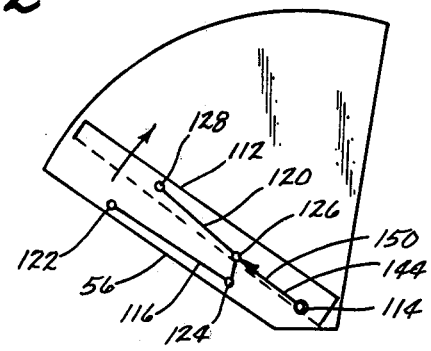
FIGS. 5, 7, 9, and 11 are schematic views of the interrelation of the toggle members shown in FIGS. 4, 6, 8, and 10, respectively.

Referring to FIGS. 4 and 5, the toggle linkage is shown in collapsed position, with the compactor blade 112 in its initial or collapsed position. Upon actuation of hydraulic cylinders 144, a force is exerted on third axis 126 in the direction represented by arrow 150 (FIG. 5). During this initial actuation of cylinder 144, frame link 116 remains motionless, and a two piece toggle linkage is formed by primary link 118 and blade link 120. The apex of this toggle linkage is designated by third axis 126. As links 118 and 120 begin spreading, they force compactor blade 112 in a clockwise direction as indicated in FIG. 5. Because the angle between links 118, 120 is relative large, the force applied by this toggle linkage is substantial, and is considerably greater than if the force were applied by a linkage having a smaller angle therebetween.

Figure 6:
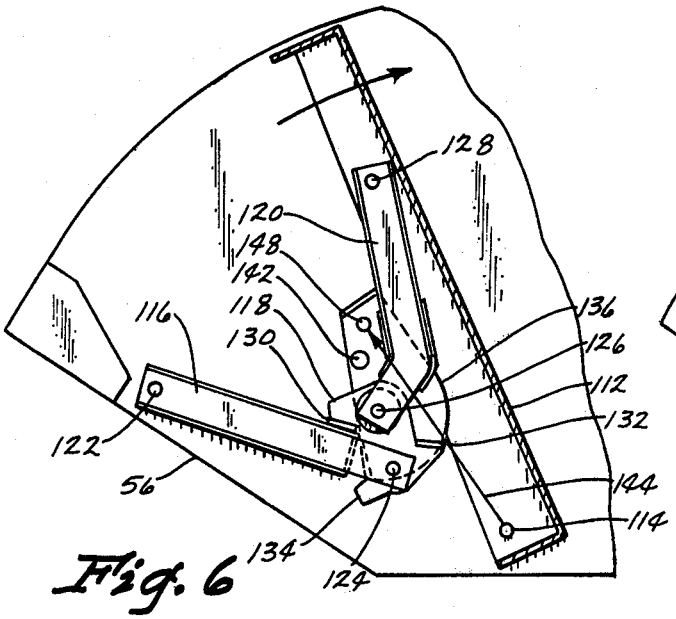
Figure 7:
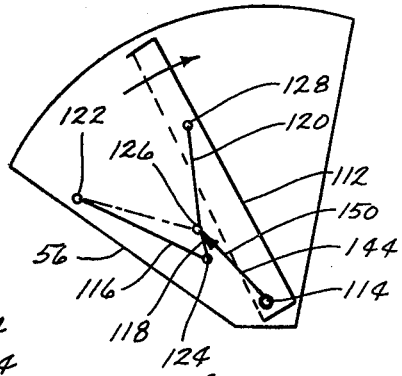

When blade 112 reaches an angle of approximately 37°, the relationship of the toggle linkage changes and this change is illustrated in FIG. 6 and 7. During the initial portion of the stroke, as can be seen in FIG. 4, stop 130 of primary link 118 is in spaced relationship to frame link 116. However, as the blade 112 moves from the position shown in FIG. 5 to the position shown in FIG. 6, primary link 118 rotates in a counterclockwise direction about second axis 124. When blade 112 reaches the angle of 37°, stop 130 comes into engagement with frame link 116, thereby preventing any further rotation of primary link 118. At this point, the toggle linkage changes from axes 124, 126, 128 as shown in FIG. 5 to axes 122, 126 and 128 as shown in FIGS. 6 and 7. The engagement of stop 130 with frame link 116 prevents primary link 118 from making any further rotational movement with respect to frame link 116. This toggle relationship represented by axes 122, 126 and 128 continues until blade 112 approaches vertical.

Figure 8:
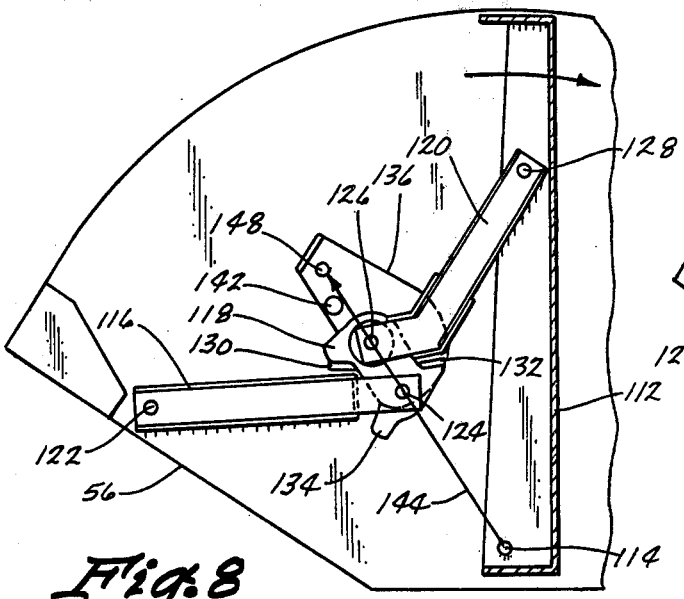
Figure 9:
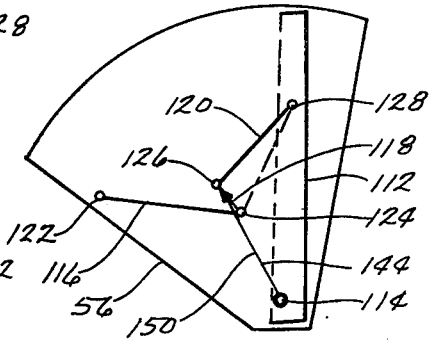

As blade 112 approaches vertical, primary link 118 begins to rotate in a clockwise direction so that stop 130 backs away from frame link 116. During this time, the toggle linkage is changing from the triangle formed by the axes 122, 126, 128 to the triangle formed by axes 122, 124, 128. (FIGS. 8 and 9).

Figure 10:
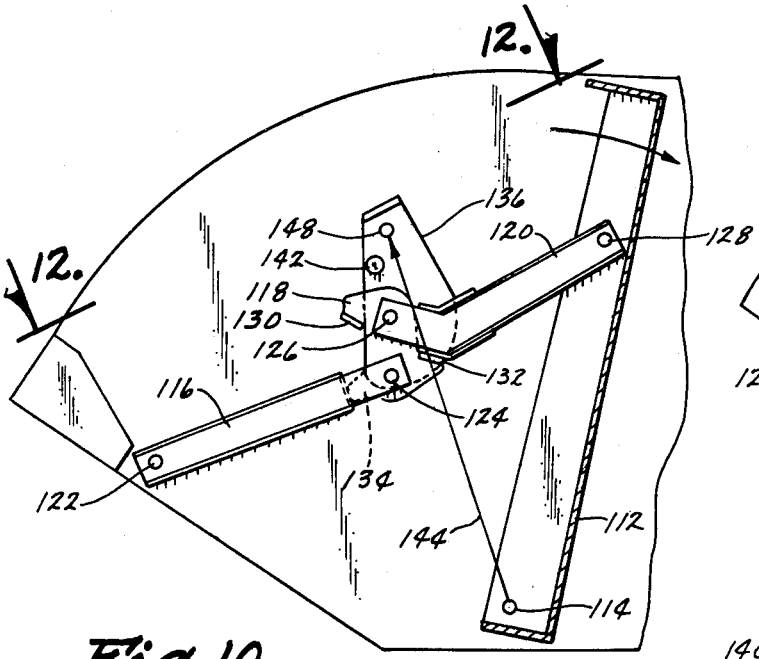
Figure 11:
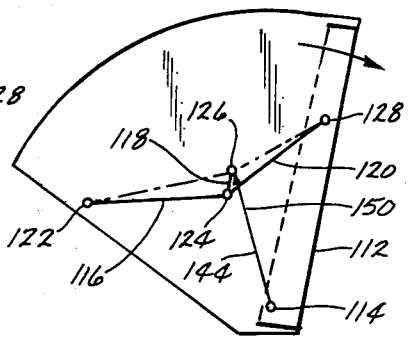

As blade 112 continues past vertical, the toggle linkage continues to expand and is illustrated in FIGS. 10 and 11. As shown schematically in FIG. 11, shortly after the blade passes over the vertical, the toggle linkage is represented by the triangle formed by axes 122, 124 and 128.

As can be seen by comparison of the schematic diagrams in FIGS. 5, 7, 9 and 11, the effective toggle triangle is changed throughout pivotal movement of blade 112 so that the most desirable power results can be obtained on blade 112 throughout its pivotal movement. Of particular importance, is the ability to exert a strong force on compactor blade 112 during the initial portion of the stroke. Also, as can be seen in FIG. 11, while the toggle linkage provides a strong force to the blade 112, it minimizes the speed with which the blade moves, and therefore minimizes the damage which can occur to the blade as a result of pressure between the blade and the material to be compacted. If a single toggle linkage were used, there would be considerably lesser power during the initial stages of the blade's movement, and furthermore, the power would be so great during the latter stages of the movement that damage could very likely result to the structure. The present toggle linkage maintains a torque on the blade from approximately 400,000 inch pounds initially to approximately 2,000,000 inch pounds at full extension. This can be done with two cylinders instead of four as in previous devices, and the hydraulic pump for operating the cylinders may be reduced from ten horsepower to five horsepower.

Stub shaft 142 of cylinder link 136 provides an important function during the initial movement of blade 112 as illustrated in FIG. 4. Stub shaft 142 engages primary link 118 and prevents cylinder link 136 from rotating in a counterclockwise direction during initial actuation of the hydraulic cylinder. Without stub shaft 142, cylinder link 136 would tend to rotate in a counterclockwise direction during the initial extension of the hydraulic cylinder. In addition, a moment is created about axis 126 by virtue of the distance between axis 126 and the longitudinal centerline of cylinder 144. This moment increases the initial force of cylinder 144 on the toggle (defined by axes 128, 126, 124) by a factor of four.

Stop 130 moves toward frame link 116 during the initial stages of extension up to the point where blade 112 reaches approximately 37°. At that point stop 130 engages frame link 116 (FIG. 6). Stop 130 starts backing away from frame link 116 as the blade 112 approaches 90° (FIG. 8). Stop 132 engages blade link 120 shortly after compactor blade 112 passes over vertical (FIG. 10).

Figure 13:
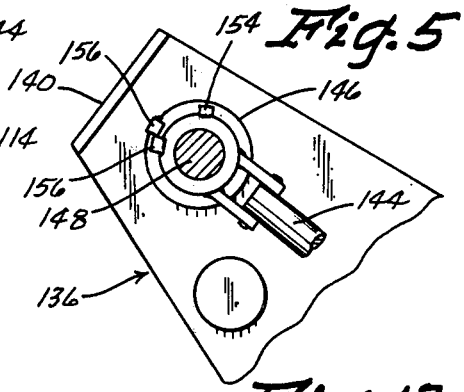
FIG. 13 is a partial sectional view of the bearing between the cylinder link and the cylinder rod.
Figure 14:
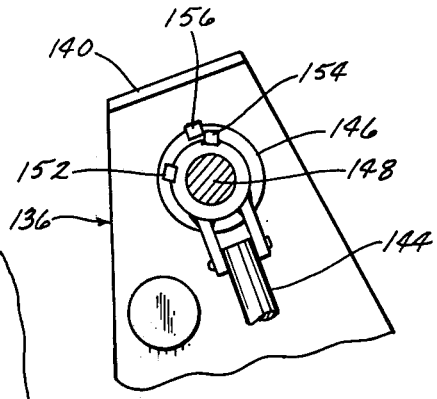
FIG. 14 is a view similar to FIG. 13 showing the bearing in a slightly rotated position.

During retraction of cylinder 144, there is a tendency of cylinder link 136 to rotate in either a clockwise or a counterclockwise direction. This tendency must be stopped in order to provide proper collapsing of the toggle linkage. Accordingly, a pair of stop shoulders 152, 154 are provided on the interior of bearing 146 (FIGS. 13 and 14). A stationary stop shoulder 156 is also mounted in bearing 146 and is adapted to engage shoulders 152 and 154 and thereby limit the rotational movement of cylinder 144 within bearing 146. Thus, as cylinder 144 is retracted, primary link 136 tends to rotate in a counterclockwise direction from the position shown in FIG. 14 to the position shown in FIG. 13. When shoulder 156 engages shoulder 152, the rotational movement is stopped, and further retraction of cylinder 144 causes collapsing of the toggle linkage.

Primary link 118 also tends to rotate in a clockwise direction during retraction of cylinder 144. In order to limit this counterclockwise movement, stop 134 is positioned to engage frame link 116 and thereby limit counterclockwise movement of primary link 118 during initial retraction of cylinder 144 (FIG. 10).

The compactor of the present invention therefore provides an improvement over compactors shown in the prior art. The toggle system applies a greater power during the initial stroke of the compactor blade, and minimizes the power during the end of the stroke so that the structure will not be damaged. The toggle linkage permits the application of the same or greater compacting force to the compacting blade, with fewer hydraulic cylinders and with a smaller hydraulic motor.

The present invention also includes several improved safety features over the previous devices. The counterbalance for the door is improved inasmuch as it neutralizes the weight of the door throughout the entire swinging movement of the door. Consequently, the door does not fly loose in an erratic manner such as the doors of presently known compactor devices. Furthermore, the counterbalance system of the present invention utilizes a compression spring which has a relatively small stroke, and which if it were to become broken or disconnected, would not be likely to present a safety hazard.

A further feature of the present invention provides the safety interlock with the hydraulic system to prevent actuation of the hydraulic system during the time that the door is open.

In the apparatus described hereinabove, some objectionable back packing has occurred. The pivoting of the compactor blade 112 encourages refuse to slide under the blade 112 which leads eventually to build-up sufficient to block the blade's movement. The structure illustrated in FIG. 16 is designed to prevent the back packing.

Figure 16:
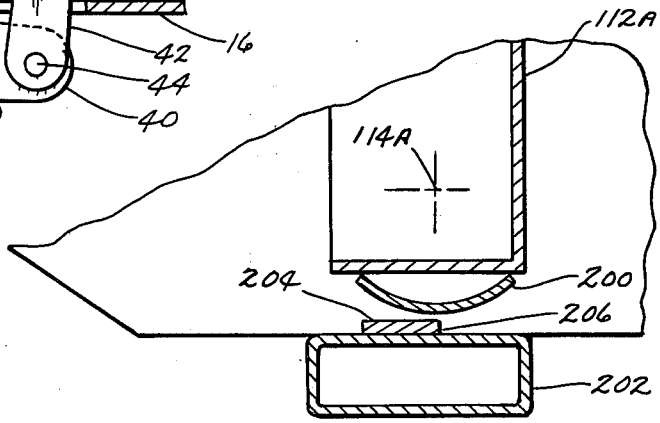
FIG. 16 is a partial sectional view of an anti-wedging device.

With respect to the structure illustrated in FIG. 16, the numeral 112A refers to a compactor blade which is identical to compactor blade 112 except that a curved plate 200 is secured to the lower end of compactor blade 112A. Plate 200 has a constant radius with respect to axis 114A as seen in FIG. 16. Crossmember 202 is positioned below compactor blade 112 and has a plate 204 mounted thereon which defines a plate edge 206 which acts as a dam to the refuse thereby preventing the refuse from passing beneath the compactor blade 112A to avoid back packing of the refuse.

What is claimed is:

1. A compactor comprising:

a container having side walls, top and bottom walls and an end wall;

a compactor blade pivotally mounted adjacent one end of said container for pivotal movement about a horizontal axis from an initial position to a compacting position, said compactor blade having upper and lower ends, said compactor blade being pivotally mounted adjacent its lower end;

power means connected to said compactor blade for pivotally moving said compactor blade;

a curved plate mounted on the lower end of said compactor blade having a radius defined by said horizontal axis;

and a stationary flat plate positioned below said curved plate and closely spaced therefrom for preventing refuse from passing beneath the lower end of said compactor blade.

2. The compactor of claim 1 wherein said flat plate presents a plate edge which acts as a dam to refuse.

* * * * *